United States Patent [19]

Robin et al.

[11] 4,218,423

[45] Aug. 19, 1980

[54] QUENCH RING AND DIP TUBE ASSEMBLY FOR A REACTOR VESSEL

[75] Inventors: Allen M. Robin, Anaheim; Americo R. Catena, Rancho Palos Verdes, both of Calif.

[73] Assignee: Texaco Inc., White Plains, N.Y.

[21] Appl. No.: 958,224

[22] Filed: Nov. 6, 1978

[51] Int. Cl.[2] ..... B01J 7/00

[52] U.S. Cl. ..... 422/207; 48/69; 48/63; 48/DIG. 2; 110/171; 261/112; 55/242; 55/256

[58] Field of Search ..... 48/DIG. 2, 69, 62, 63, 48/64, 77, 215, 206, 73; 239/298; 55/242, 255, 256; 261/7, 112; 110/215, 216, 171; 422/207; 266/146

[56] References Cited

U.S. PATENT DOCUMENTS

| | | | |
|---|---|---|---|
| 2,818,326 | 12/1957 | Eastman et al. | 48/196 R |
| 2,896,927 | 7/1959 | Nagle et al. | 261/112 |
| 3,998,609 | 12/1976 | Crouch et al. | 48/215 |

*Primary Examiner*—S. Leon Bashore
*Assistant Examiner*—Michael Goldman
*Attorney, Agent, or Firm*—Carl G. Ries; Robert A. Kulason; Henry C. Dearborn

[57] ABSTRACT

An assembly of a quench ring and dip tube is for use with a reactor vessel. It is particularly beneficial where the reactor generates large quantities of molten slag. The quench ring is mounted against the floor of the reactor vessel for cooling same, and there are a plurality of spray passages directing cooling water against the inside of the dip tube which surrounds the ring at the upper end, while extending into a bath of quench water.

4 Claims, 7 Drawing Figures

QUENCH RING AND DIP TUBE ASSEMBLY FOR A REACTOR VESSEL

BACKGROUND OF THE INVENTION

1. Field of the Invention

This invention concerns reactor vessel structure in general. More specifically, it relates to an improved quench ring and dip tube assembly for application to a reactor vessel.

2. Description of the Prior Art

In processes for gasifying coal or coke, it has been found that large quantities of molten slag are produced. Such slag must be removed from the generator vessel which operates at high pressures. The usual manner of removing the slag thus produced has entailed the division of a reactor into two sections. The top section is a refractory lined reaction section, while the bottom section is a water filled quench chamber. The molten slag is allowed to drop into the water whereupon it solidifies, and the solid particles of slag are then removed from the bottom section using a lock hopper system. The generator floor between the top and bottom sections must be cooled, and this has been accomplished using a quench ring that is bolted to the bottom of the floor and through which water is circulated. Furthermore, it has been found beneficial to include a so-called dip tube which carries the slag into the quench chamber with the gas that is leaving the generator and which then flows through the quench bath while the slag is solidified therein.

Arrangements of the sort indicated above are shown in prior patents e.g. U.S. Pat. No. 2,818,326 to Eastman et al, Dec. 31, 1957 and U.S. Pat. No. 2,896,927 Nagel et al, July 28, 1959. However, the quench ring and dip tube structures employed by those patents have made use of a structure which has a narrow annular opening around the edges of the quench ring for directing a stream of cooling water onto the inside of the dip tube. With that arrangement it was very difficult to maintain the dimensional accuracy and stability required, so that when some of the opening for directing the cooling water onto dip tube become clogged, the cooling of the dip tube would be uneven, and warping with consequent damage tended to result. Also, the prior dip tube and quench rings were constructed as a single integral unit and this was costly to manufacture.

Consequently it is an object of this invention to provide an improved quench ring and dip tube assembly that is more reliable in action and easier to construct.

SUMMARY OF THE INVENTION

Briefly, the invention concerns an improved quench ring and dip tube assembly for a reactor vessel having a refractory lined reactor chamber with a bottom outlet and a floor to support said lining. It comprises an annular conduit for carrying cooling water therein and adapted for mounting against said floor and surrounding said bottom outlet. It also comprises a dip tube for carrying hot gas and for directing molten slag from said outlet into a bath of quench water therebeneath, and means for mounting said dip tube surrounding said annular conduit. It also comprises a plurality of passages for directing said cooling water against the inside of said dip tube to prevent said slag from sticking thereto.

Once more briefly, the invention concerns an improved quench ring and dip tube assembly for a reactor vessel having a refractory lined reactor chamber with a bottom outlet and a floor to support said lining. It comprises an annular U-shaped panel for carrying cooling water therein and adapted for mounting against said floor to form a conduit for said cooling water surrounding said bottom outlet tube, and a dip tube for carrying hot gas and for directing molten slag from the outlet into a bath of quench water therebeneath. It also comprises means for mounting said dip tube surrounding said annular channel and extending into said quench water, and inlet coupling means for introducing said cooling water into said channel. It also comprises a plurality of passages spaced circumferentially apart around said annular channel. The said passages connect into said U-shaped channel above the bottom thereof to avoid clogging, and the said passages are angled downward and radially outward and skewed circumferentially to direct said cooling water against the inside of said dip tube with a swirl to prevent said slag from sticking thereto.

BRIEF DESCRIPTION OF THE DRAWINGS

The foregoing and other objects and benefits of the invention will be more fully set forth in connection with the best mode contemplated by the inventors of carrying out the invention, and in connection with which there are illustrations provided in the drawings, wherein.

DESCRIPTION OF THE EMBODIMENTS

As indicated above, this invention is particularly applicable to a process that makes use of a generator, or reactor vessel, which has a refractory lined reaction chamber, and which process generates large quantities of molten slag. Such a reactor vessel has a bottom outlet, and the molten slag is allowed to fall through while the hot gas is also withdrawn through the same outlet. Heretofore the generator floor was cooled with a quench ring, and the molten slag was directed into a quench bath beneath, through a dip tube. Also, to cool the dip tube and keep the slag from sticking to the sides thereof, there was a stream of water from the quench ring that was directed onto the inside walls of the dip tube. However, difficulties were encountered in connection with uneven flow of the cooling water down the walls of the dip tube. That tended to cause uneven heating and therefore malfunction by warping and the like, took place.

Figure 1:
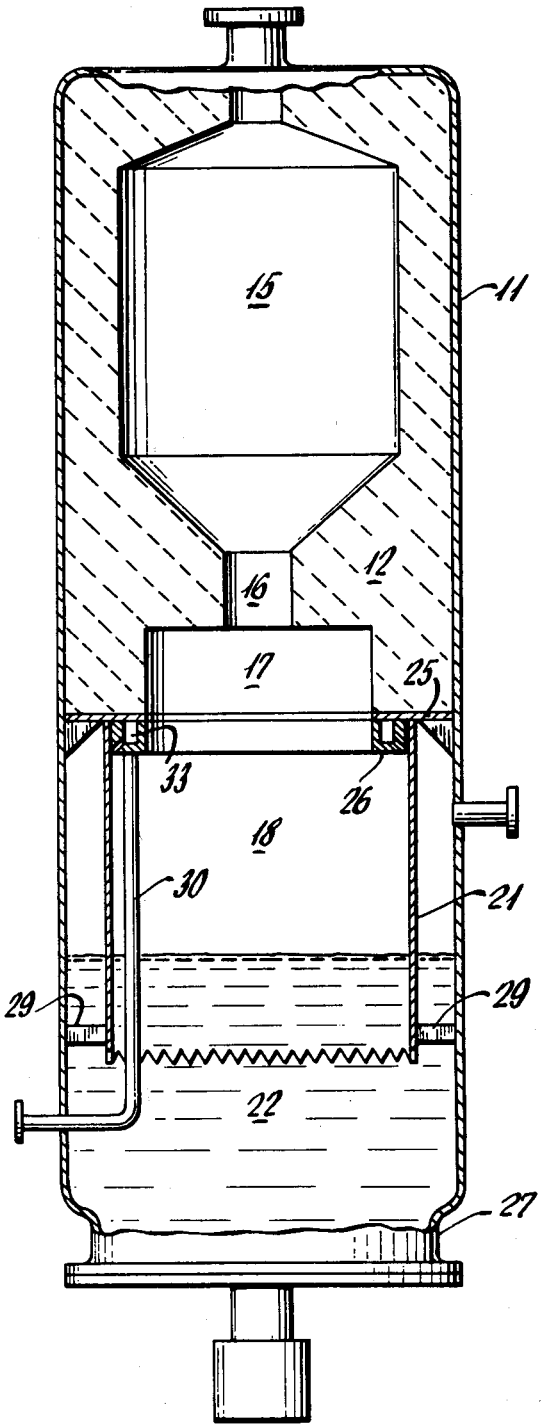
FIG. 1 is a schematic longitudinal cross section illustrating a generator with an assembly according to the invention mounted therein.

FIG. 1 illustrates a reactor vessel 11 that has a refractory lining 12 which forms a reactor chamber 15. There is a bottom outlet from the chamber 15 which includes a narrow throat section 16. The outlet continues through an enlarged opening 17 that connects into a space 18 inside a dip tube 21, and above a bath of quench water 22.

The refractory lining 12 of the generator is supported by a floor 25 that is cooled by a quench ring 26. The dip tube 21 fits outside of the quench ring 26 and is supported vertically by a number of horizontal braces 29. It may be noted that the dip tube 21 is constructed to slide over the quench ring 26 or, alternatively, to be attached thereto by welding or the like (not shown).

It may be noted that the dip tube 21 may be mounted by being inserted vertically through a flanged bottom opening 27 of the generator vessel 11, prior to filling with the quench water 22.

Figure 2:
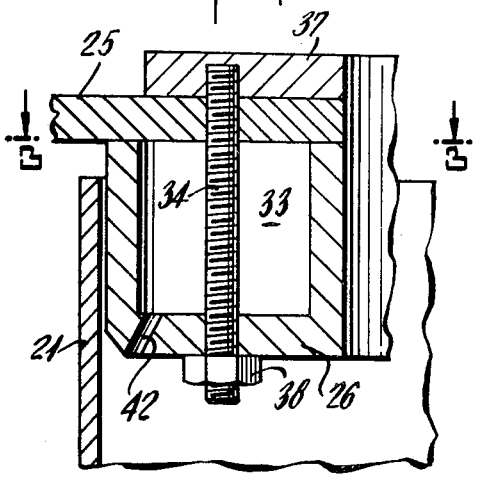
FIG. 2 is an enlarged cross sectional detail, illustrating the quench ring and dip tube relationship according to one modification of the invention.
Figure 3:
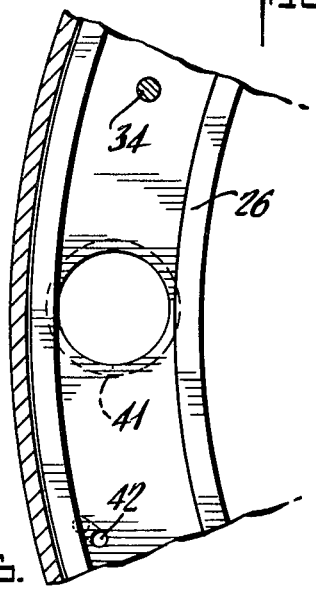
FIG. 3 is a somewhat less enlarged fragmented plan view taken along the lines 3—3 of FIG. 2.
Figure 4:
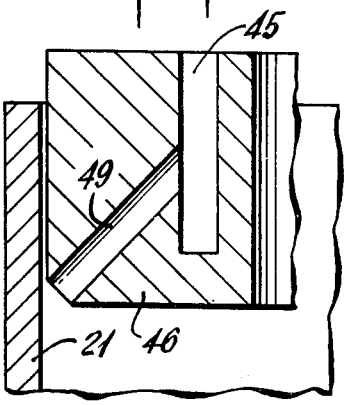
FIG. 4 is an enlarged cross sectional view similar to FIG. 2, but illustrating a different modification of the quench ring according to the invention.

The quench ring 26 may take alternative forms, e.g., the modification illustrated by FIGS. 2 and 3 or the alternative modification illustrated by FIGS. 4–7. In either modification, there is cooling water supplied to the hollow interior of the quench ring 26. This is accomplished, as indicated, by an inlet water supply pipe 30 which is connected to the ring 26. It will be understood that, preferably, there would be two of these cooling water supply pipes connected at approximately 180° apart around the ring 26.

As indicated in the detailed showings of FIGS. 2 and 3, the quench ring 26 may take the form of an annular U-shaped channel which forms a conduit 33 for carrying the cooling water therein. The ring 26 is attached directly onto the bottom surface of the floor 25 of the generator. This may be done in any feasible manner, e.g. by securing it with a plurality of bolts 34 that pass through the floor 25 and the bottom of the ring 26, as indicated. The bolts 34 may be threaded into a clamp plate 37 located above the floor 25. With this arrangement there is, of course, a nut 38 that cooperates with each of the bolts 34.

The FIG. 3 view indicates a coupling nipple 41 that is employed to attach the pipe 30, for supplying the cooling water into the conduit 33.

There are a plurality of short passages 42 that are drilled through the quench ring 26. They are spaced circumferentially apart all the way around the ring 26 and are angled toward the inside of the dip tube 21 with a skewed angle for creating a swirl of the cooling water being directed against the inside of the dip tube.

It may be noted that an advantage of construction according to this invention over the prior known annular slit structure for directing cooling water onto a dip tube, is that indicated above. That is, the individual holes may be made large enough to pass small particles of soot that are usually found in recycled water. Also, the number of holes and hole spacing may be designed to ensure sufficient water velocity at particular flow rates to obtain adequate cooling action. Furthermore, if one or two holes should become plugged, the velocity of the water through the remaining holes will increase and this will increase the swirling action and maintain uniform coverage of the tube wall.

FIGS. 4–7 illustrate a modified construction, or form of the quench ring and the cooling water passages used therewith. Thus, it will be noted that the U-shaped channel is formed with a much narrower annular opening 45 which forms a narrow conduit, as compared with the conduit 33 of the FIGS. 2 and 3 modification. In this case, a quench ring 46 has a corresponding plurality of passages 49 which act similarly to the passages 42 of the prior modification. However, in this modification (according to FIGS. 4–7) the passages 49 are drilled with a similar angle toward the dip tube surface, but are located so as to connect with the opening 45 (which forms the cooling water conduit) considerably above the bottom thereof. This permits a settling of particles in the cooling water, which might otherwise tend to plug the passages.

Figure 6:
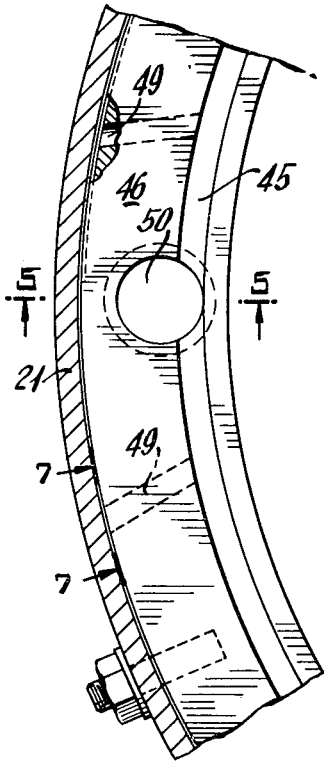
FIG. 6 is a somewhat less enlarged fragmented plan view showing the elements of the FIGS. 4 and 5 modification.
Figure 7:
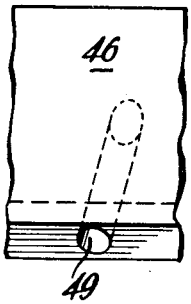
FIG. 7 is an enlarged detail in elevation showing the construction of a cooling water passage as viewed along the lines 7—7 on FIG. 6.

As in the first modification, the passages 49 (of the second modification) are angled for some skew. This is indicated in FIGS. 6 and 7, and it acts so as to provide the desirable swirling action of the cooling water.

Figure 5:
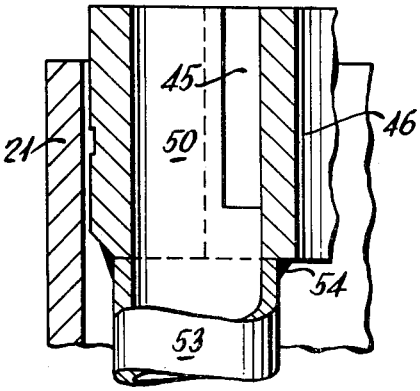
FIG. 5 is another enlarged cross sectional view of the modification illustrated in FIG. 4, but taken along the lines 5—5 on FIG. 6 and showing an inlet coupling for cooling water to the quench ring.

In this later modification, the cooling water is supplied to the conduit 45 by one or more coupling wells 50 that, each have a cooling water pipe 53 attached thereto, as indicated in FIG. 5. This attachment may, of course, be in any feasible manner such as by welding 54 as indicated in FIG. 5.

While particular embodiments of the invention have been described above in considerable detail, in accordance with the applicable statutes, this is not to be taken as in any way limiting the invention but merely as being descriptive thereof.

We claim:

1. Improved quench ring and dip tube assembly in combination with a reactor vessel having a refractory lined reactor chamber with a bottom outlet and a floor to support said lining, comprising an annular conduit for carrying cooling water therein and adapted for mounting against said bottom outlet and said floor, a dip tube for carrying hot gas and for directing molten slag from said outlet into a bath of quench water therebeneath, said dip tube extending into the quench water to form a liquid seal, means for mounting said dip tube surrounding said annular conduit, and a plurality of individual passages angled downward and radially outward and skewed circumferentially to swirl said cooling water and for directing said cooling water against the inside of said dip tube to prevent said slag from sticking thereto.

2. Improved assembly according to claim 1, wherein said annular conduit comprises a U-shaped channel.

3. Improved assembly according to claim 2, further comprising inlet coupling means for introducing said cooling water into said channel.

4. Improved quench ring and dip tube assembly in combination with a reactor vessel having a refractory lined reactor chamber with a bottom outlet and a floor to support said lining, comprising an annular U-shaped channel for carrying cooling water therein and adapted for mounting against said floor to form a conduit for said cooling water surrounding said bottom outlet, a dip tube for carrying hot gas and for directing molten slag from said outlet into a bath of quench water therebeneath, means for mounting said dip tube surrounding said annular channel and extending into said quench water, inlet coupling means for introducing said cooling water into said channel, and a plurality of passages spaced circumferentially apart around said annular channel, said passages connecting into said U-shaped channel above the bottom thereof to avoid clogging, and said passages bring angled downward and radially outward and skewed circumferentially to direct said cooling water against the inside of said dip tube with a swirl to prevent said slag from sticking thereto.

* * * * *